United States Patent [19]

Meservy et al.

[11] Patent Number: 5,044,807

[45] Date of Patent: Sep. 3, 1991

[54] ADJUSTABLE WRITING PLATFORM FOR A NOTEBOOK

[76] Inventors: Jay A. Meservy, 564 Pheasant Cir., Bountiful, Utah 84010; Jerry D. Meservy, 692 South 850 East, Centerville, Utah 84014

[21] Appl. No.: 532,050

[22] Filed: Jun. 1, 1990

[51] Int. Cl.[5] ..... B42F 13/00; B42F 13/40

[52] U.S. Cl. ..... 402/80 L; 402/8; 402/73; 402/502; 248/454

[58] Field of Search ..... 248/454, 459; 402/73, 402/74, 75, 76, 77, 78, 79, 80 R, 80 L, 502

[56] References Cited

U.S. PATENT DOCUMENTS

| | | | |
|---|---|---|---|
| 2,309,474 | 1/1943 | Neilson | 402/78 X |
| 3,091,482 | 5/1963 | Cirigliano | 402/73 X |
| 4,240,761 | 12/1980 | Jacobson | 402/76 |
| 4,595,309 | 6/1986 | Chinchar | 402/80 R |
| 4,880,327 | 11/1989 | Sanabria | 402/73 |

FOREIGN PATENT DOCUMENTS

| | | | |
|---|---|---|---|
| 329002 | 11/1920 | Fed. Rep. of Germany | 402/73 |
| 812308 | 8/1951 | Fed. Rep. of Germany | 402/502 |
| 1570581 | 6/1969 | France | 248/454 |

*Primary Examiner*—Paul A. Bell

*Attorney, Agent, or Firm*—J. Winslow Young

[57] ABSTRACT

A writing platform for a notebook, the writing platform including a writing table that can be elevated from a flat configuration to an elevated position along one edge so as to provide a writing surface underneath one or more pages in the notebook. A riser is hingedly joined to the writing table and supports the edge of the writing table at a preselected elevation. Detent means are included to releasably support the riser in a generally vertical orientation. The dimensional characteristics of the writing table, the riser, and the detent means determine the ultimate elevation of the edge of the writing table.

15 Claims, 7 Drawing Sheets

ADJUSTABLE WRITING PLATFORM FOR A NOTEBOOK

BACKGROUND

1. Field of the Invention

This invention relates to notebook accessories and, more particularly, to a writing platform apparatus and method for a looseleaf notebook for elevating pages within the notebook.

2. The Prior Art

Notebooks of various looseleaf varieties have been known for decades. These notebooks are used for numerous purposes although the primary purpose, as the name "notebook" implies, is that of recording handwritten notes. One especially popular form of looseleaf notebook is a personal calendar/notebook combination commonly referred to as a "day planner". The usual format for a day planner is that it includes a separate page for each day of the year with each page segregated into hourly blocks along with an area for notes, reminders, expenditures, and the like. A separate section of the day planner includes a series of alphabetically arranged pages for use as a directory.

Clearly, the inherent value of such a looseleaf notebook is through regular usage by the owner. This means that the person using the looseleaf notebook should write in the notebook on a regular basis. However, it is well known that a notebook with a substantial number of pages represents a difficult writing surface due to the nature of the looseleaf notebook. In particular, the pages held by the ring binder will vary greatly in thickness depending upon which page is to be written upon and also which side of the particular page is being used. These problems are particularly exacerbated by the fact that day planners are specifically configured to be as compact as possible for purposes of handling convenience. The result is that considerable distortion of the pages is encountered making writing on them particularly awkward. Further, depending upon which side of the page is being written upon and the thickness of the total number of pages underneath this particular page, writing in a notebook is quite cumbersome to the extent that many people become discouraged and do not write in the day planner as much as they should.

However, perhaps the most serious difficulty is encountered when the writer must place his or her writing hand across the rings of the ring binder of the notebook. This is particularly troublesome for persons who write left handed on the right side of the notebook because of the nature of the hand position assumed while writing. Customarily, the left-handed person holds the writing hand above the area being written upon with the fingers holding the writing implement being curved downwardly toward the wrist. This writing position is adopted to enable the writer to be able to visually observe what is being written. In other words, the left-handed writer writes on a page from above which means that the forearm and wrist, at the minimum, are forced to contend with the ring binder while writing on the right side of the page. Correspondingly, the person writing with the right hand on the left side of the notebook encounters the ring binder with the right hand as the page is written on from left to right. This means that a person writing close to the ring binder encounters interference with the right side of the right hand prior to the writing implement being brought into proximity with the ring binder.

An alternative solution to these problems is to remove the particular page from the notebook and place it upon a separate writing surface for writing. This is awkward particularly if no suitable writing surface is conveniently available. Further, opening the looseleaf binder to remove a specific page to be written upon momentarily releases the remaining pages so that they can become loose and even fall out of the notebook. Accordingly, a person who uses the day planner on a consistent basis is required to write on pages that are not adequately supported on a suitable writing surface.

In view of the foregoing it would be a significant advancement in the art to provide a writing surface for pages in a looseleaf notebook. It would also be an advancement in the art to provide a support surface for pages of a looseleaf notebook whereby the support surface can be elevated to at least one of a plurality of elevated positions to support pages to be written upon and lowered into a flat, relatively unobtrusive position for storage. Such a novel apparatus and method is disclosed and claimed herein.

BRIEF SUMMARY AND OBJECTS OF THE INVENTION

This invention involves an adjustable, semirigid support surface or writing platform for looseleaf notebooks. The writing platform can be elevated to provide a support surface underneath the particular set of pages being written upon. The writing platform is configured to be either permanently or releasably mounted in the looseleaf notebook and includes a foldable riser for raising the platform at least one of a plurality of elevations above the plane of the underlying notebook outer binder.

It is, therefore, a primary object of this invention to provide improvements in writing support surfaces for looseleaf notebooks.

Another primary object of this invention is to provide improvements in the method of providing support to a page of a looseleaf notebook.

Another object of this invention is to provide a writing platform for a looseleaf notebook whereby the writing platform can be elevated to a predetermined position to support a page being written upon and lowered into a relatively flat configuration for storage during periods of nonuse.

Another object of this invention is to provide a writing platform for selectively supporting pages to be written upon, the writing platform being capable of being elevated to more than one position.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENTS

Figure 1:
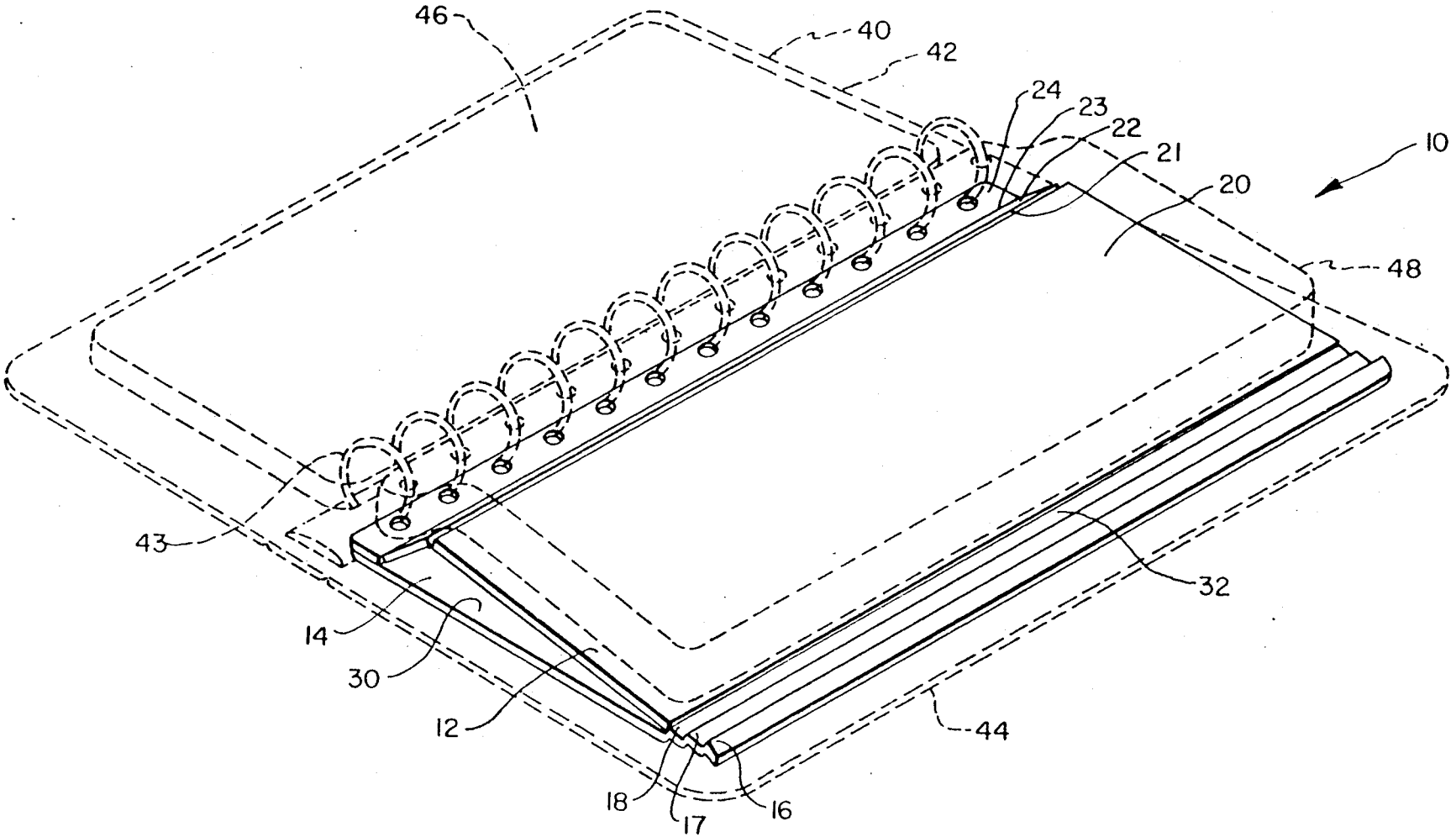
FIG. 1 is a perspective view of a first preferred embodiment of the novel writing platform of this invention shown in the environment of a looseleaf notebook.
Figure 2:
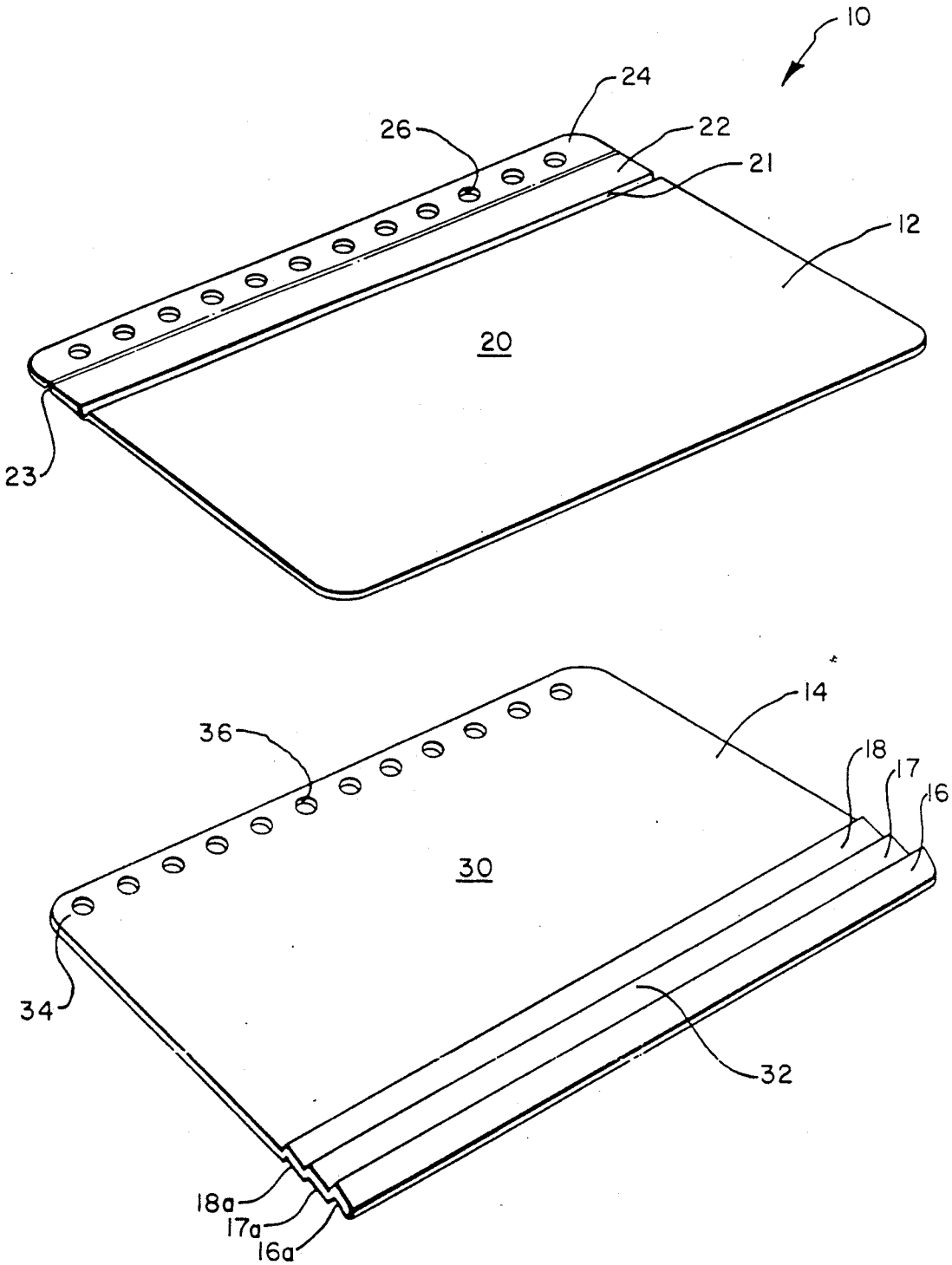
FIG. 2 is an exploded, perspective view of the first preferred embodiment of the writing platform of FIG. 1.

The invention is best understood by reference to the drawing wherein like parts are designated by like numerals throughout in conjunction with the following description.

General Discussion

The novel writing platform of this invention is designed to allow a person using a notebook to selectively elevate a portion of the pages in the looseleaf notebook to a predetermined elevation so as to accommodate the user being able to easily write upon the page so elevated. The writing platform is configured to elevate the pages adjacent the rings of the notebook and support the balance of the page toward the outer edge of the pages with a writing table so that even though the overall configuration of the support is generally wedge-like, the pages are supported adequately to substantially eliminate interference by the rings.

The material of construction for the writing platform can be any suitable material of construction such as plastic, cardboard, leather, or wood; although the preferred material is plastic due to its characteristics of being readily formable, available, and relatively inexpensive. While numerous suitable plastics, such as polyethylene, polycarbonate, and the like, are available, polypropylene has been found to exhibit the desired features of allowing the writing platform in its various embodiments to be readily fabricated by injection molding techniques.

Detailed Description

Referring now to FIGS. 1-5, a first preferred embodiment of the novel writing platform of this invention is shown generally at 10 in the environment of a looseleaf notebook 40 (shown in broken lines for ease of illustration). Writing platform 10 includes a writing table 12 and a basal element 14, both of which are configured to be releasably engaged by rings 43 of looseleaf notebook 40. With specific reference to FIG. 2, writing table 12 includes a writing surface 20 hingedly joined to a riser 22 at a hinge 21. Riser 22 is, in turn hingedly joined to an upper retainer strip 24 at a hinge 23. Retainer strip 24 includes a plurality of spaced holes 26 which are configured to releasably receive rings 43 of looseleaf notebook 40. The operation of writing table 12 will be discussed more fully hereinafter.

Basal element 14 includes a basal surface 30 extending between a retainer edge 34 having therein a plurality of spaced holes 36 which, like holes 26, are configured to releasably engage rings 43 of looseleaf notebook 40. Basal element 14 includes a plurality of detents 16-18, the function of which will be discussed more fully hereinafter. Detents 16-18 are molded into the outside edge of basal element 14 and are formed by being created from grooves 16*a*-18*a* pressed upwardly into the bottom surface of basal element so as to create corresponding detents 16-18.

Figure 4:
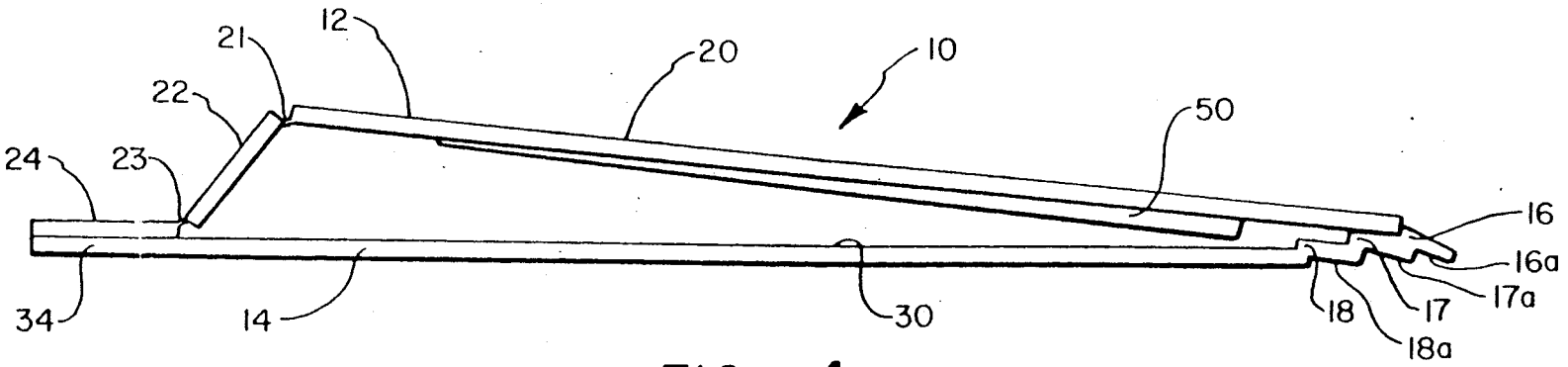
FIG. 4 is an end view of the first preferred embodiment of the writing platform shown in the raised configuration.
Figure 5:
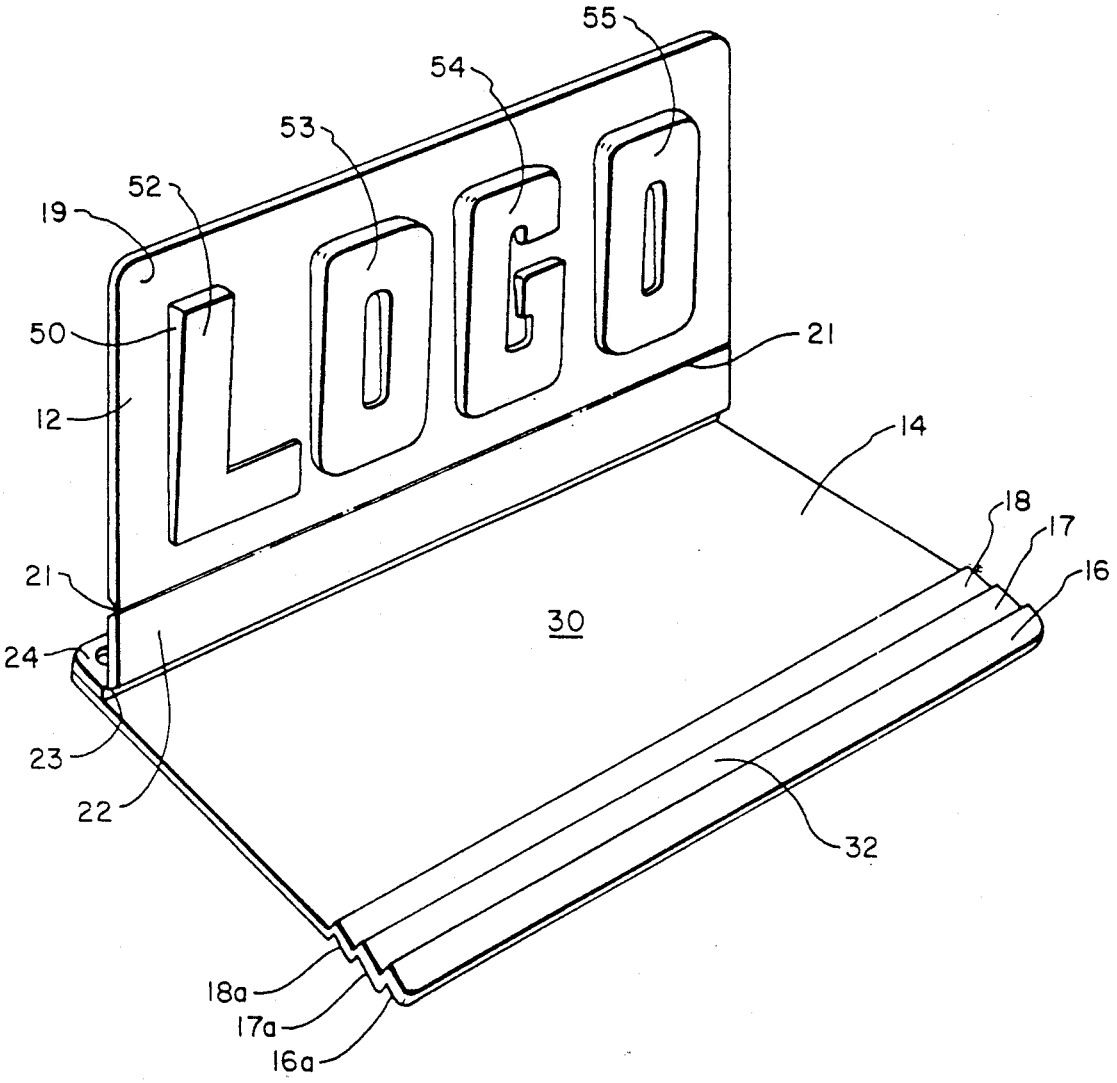
FIG. 5 is a perspective view of the first preferred embodiment of the writing platform shown with the writing surface in an opened configuration to illustrate the incorporation of a logo on the under side of the writing surface for purposes of providing rigidity to the writing surface.

Referring now more particularly to FIG. 5, writing table 12 is shown mounted to basal element 14 but with riser 22 angularly offset from retainer strip 24 and coplanar with writing surface 20 (FIG. 1-4) so that bottom surface 19 thereof is shown. Importantly, bottom surface 19 includes a raised indicia 50 shown herein as the word LOGO including letters 52-55 which represent the letters L, O, G, and O, respectively. Indicia 50 can be any suitable indicia but is specifically configured to lend rigidity or otherwise serve as a stiffener to writing table 12, or more specifically, writing surface 20 (FIGS. 1-4).

Figure 3:
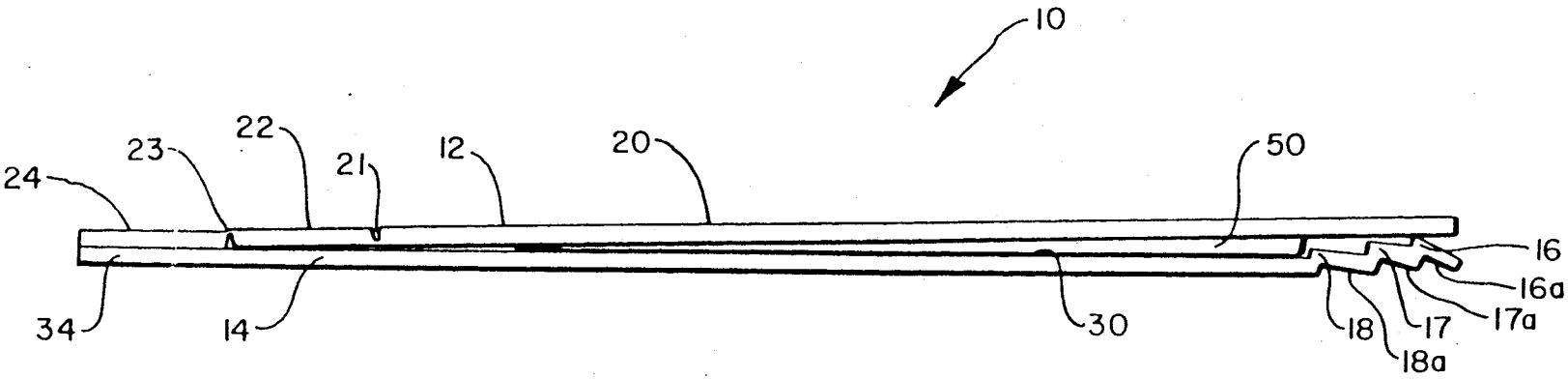
FIG. 3 is an end view of the first preferred embodiment of the writing platform shown in the flat configuration.

Referring now specifically to FIGS. 3 and 4, indicia 50 is shown in an end view of writing platform 10. In particular, it should be noted that writing table 12 rests on the top of detent 16 as shown in FIG. 3. Thus, a thin, wedge-like gap is formed in the space bounded by detent 18 on the right and retainer strip 24 on the left (between writing table 12 and basal element 14). Accordingly, indicia 50 is configured with a correspondingly dimensioned wedge-like profile so as to reside within the confines of the foregoing wedge-like gap. Indicia 50 thereby provides an increased degree of rigidity to writing table 12 without interfering with the juxtaposition of writing table 12 with basal element 14 as shown in FIG. 3.

Referring to FIGS. 1 and 4, writing table 12 is raised to an elevated position by folding hinge 21 upwardly to orient riser 22 to a generally vertical position. Hinge 23 allows riser 22 to be oriented upwardly from retainer strip 24 so as to rigidly support the left edge of writing surface 20 while the right edge of writing surface is engaged with one of detents 16-18, in this instance, detent 16 (FIG. 4) or detent 18 (FIG. 1). The degree of elevation of writing surface 20 is selectively predetermined by the relative dimensional characteristics of the width of riser 22 and writing surface 20 as well as the widths and placement of detents 16-18.

Looseleaf notebook 40 includes a front cover 42, a back cover 44, and the set of rings 43 for holding a front set of pages 46 and a back set of pages 48 in the conventional manner of looseleaf notebooks. The number of pages in either of front set of pages 46 and back set of pages 48 is selectively variable so that it becomes necessary to be able to vary the degree of elevation of writing surface 20, as described hereinbefore. Further, writing platform 10 is readily adaptable to being mounted on either side of notebook 40. For example, as illustrated in FIG. 1, writing platform 10 is shown on the right side of notebook 40 underneath back set of pages 48 and in juxtaposition with back cover 44. Writing platform 10 can be placed under front set of pages 46 by removing it from rings 43 and reversing the orientation of writing platform 10 so as to place basal element 14 in juxtaposition with front cover 42 when again mounted on rings 43. Importantly, writing table 12 remains on top of basal element 14 so that the operation of writing surface 20 under front set of pages 46 is identical to its operation under back set of pages 48 as described hereinbefore. Everything remains the same except that writing platform 10 is switched end-for-end while retaining writing surface 20 in an upwardly oriented position.

Referring again specifically to FIG. 1, writing platform 10 is mounted on the right side of notebook 40 which means that it is configured to provide writing support for a person writing in notebook 40 with the left hand. In particular, writing platform 10 has raised the ring binder edge of pages 48 into a position where they are essentially flush with the top of rings 43. In this position, the left-handed writer (not shown) is able to write on pages 48 while experiencing minimal interference from rings 43.

Figure 6:
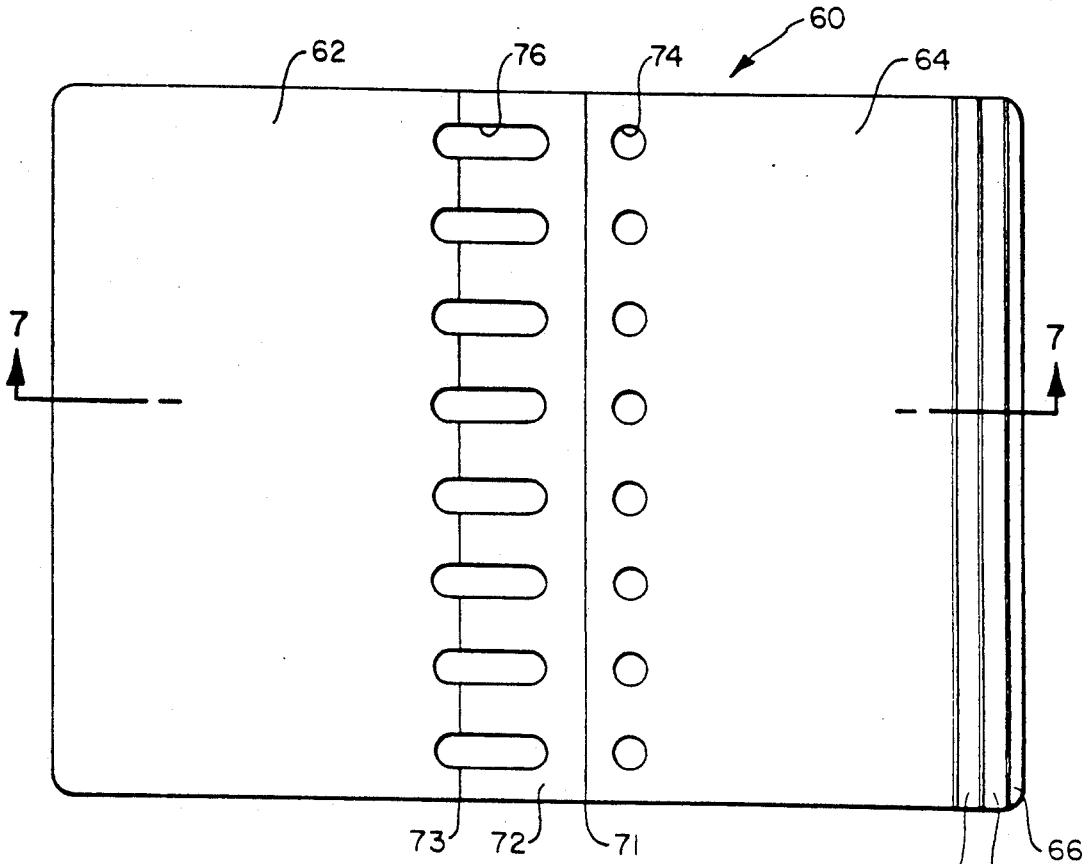
FIG. 6 is a plan view of a second preferred embodiment of the novel writing platform of this invention.
Figure 7:
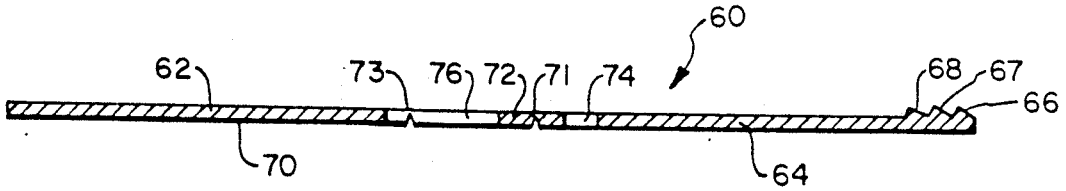
FIG. 7 is a cross sectional view taken along lines 7—7 of FIG. 6.
Figure 8:
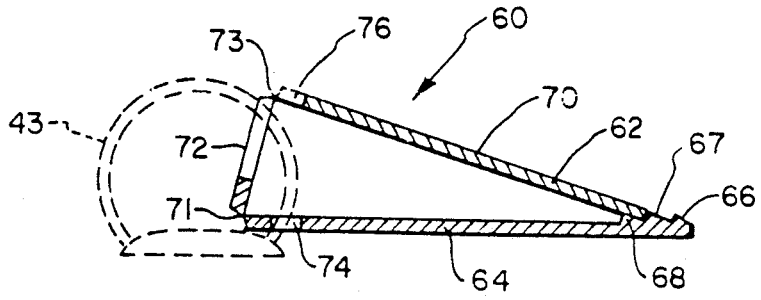
FIG. 8 is the cross sectional view shown in FIG. 7 but with the writing platform shown in the elevated position and in the environment of a ring binder for a looseleaf notebook.

Referring now to FIGS. 6–8, a second preferred embodiment of the novel writing platform of this invention is shown generally at 60 and includes a writing table 62 and a basal element 64 both of which are interconnected by a riser 72 at a hinge 71 (with basal element 64) and at a hinge 73 (with writing table 62). Writing platform 60 is specifically fabricated from a single panel of suitable construction material such as a rigid or semi-rigid plastic. Importantly, the plastic material must include the desirable feature of being compatible with the formation of the respective hinges therein (hinges 21 and 23, FIGS. 1–5, and hinges 71 and 73, FIGS. 6–8). Such hinges are well known in the art and are used in numerous applications.

Writing platform 60 includes a plurality of spaced holes 74 along an edge of basal element 64 and a corresponding plurality of spaced slots 76 extend from an incremental distance through riser 72 into writing table 62 so as to accommodate a cooperative relationship with rings 43 (FIGS. 1 and 4). In particular, slots 76 allow riser 72 to be raised from a horizontal position (not shown) in juxtaposition with basal element 64 to the elevated position shown in FIG. 8. This allows writing table 62 to be raised to any of the positions regulated by detents 66–68 without having to remove writing platform 60 from ring 43. When folded to the flat configuration (not shown but similar to that shown in FIG. 3), riser 72 is brought downwardly until it rests against the left edge of basal element 64 with left end of slots 76 superimposed over holes 74 and the right edge of writing table 62 rests on detent 66.

Writing platform 60 is mountable on either side of rings 43 (see notebook 40, FIG. 1) so as to support the respective overlying pages in the manner described hereinbefore with respect to the first preferred embodiment of this invention, writing platform 10, shown in FIGS. 1–5. The principle difference is that writing platform 60 is fabricated from a single piece of plastic material that is folded upon itself as shown at FIG. 8 to provide the desired degree of elevation to writing surface 70. As illustrated in FIG. 8, writing platform 60 is mounted on the right side of rings 43 so that it is in position to elevate pages 48 (FIG. 1) to the benefit of a person (not shown) writing thereon using the left hand.

Figure 9:
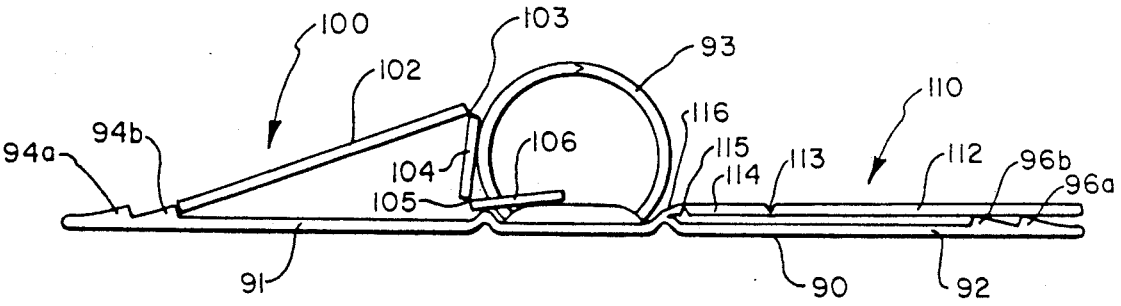
FIG. 9 is an end view of two adaptations of a third preferred embodiment of the novel writing platform of this invention shown in the environment of a portion of a notebook.

Referring now to FIG. 9, two versions of a third preferred writing platform of this invention are shown generally at 100 and 110 in the schematically illustrated environment of a notebook 90. Writing platform 100 is configured with a writing table 102, a riser 104, and a retainer strip 106. Writing platform 100 is fabricated from a suitable plastic material such as polypropylene so as to accommodate the fabrication of hinges 103 and 105 therein. Hinge 103 provides the hinge element between riser 104 and writing table 102 while hinge 105 provides the hinge element between riser 104 and retainer strip 106. Retainer strip functions identically to retainer strip 24 (FIG. 2) in that it anchors riser 104 and writing table 102 to rings 93 of notebook 90. As shown, writing table 102 is elevated to its uppermost position by the folding of hinges 103 and 105 so that riser 104 is oriented vertically and the opposite edge of writing table 102 is engaged against a detent **94*b* molded into the surface of cover 91 of notebook 90. Another, spaced detent, detent 94*a* is also provided in cover 91 to accommodate the slight change in elevation of writing table 102 when the edge of writing table 102 is engaged with detent 94*a***.

The configuration of writing platform 100 is particularly advantageous because it represents a single, planar element segmented at hinges 103 and 105 into the respective components, writing table 102, riser 104, and retainer strip 106. Importantly, the detents, detents **94*a* and 94*b* are either formed as an integral part of cover 91** or may be detachably mounted thereto.

A second writing platform 110 is shown on the right side of notebook 90 and is shown as permanently mounted between rings 93 and cover 92. A retainer strip 116 is secured therein during manufacture of notebook 90 and is hingedly joined to a riser 114 at a hinge 115 while a writing table 112 is joined to riser 114 at a hinge 113. All of the elements of writing platform 110 are identical to those of writing platform 100 with the exception of the mounting mechanism for mounting the respective writing platform to notebook 90. Detents **96*a* and 96*b* cooperate with the outside edge of writing table 112 to provide the support necessary to enable riser 114 to elevate writing table 112 to the preselected elevation above cover 92. Advantageously, any or all of detents 94*a*, 94*b*, 96*a*, and 96*b* can be in the form of a demountable clip, a sewn ridge, or molded directly into the material of construction of covers 91 and 92, respectively, Referring now to FIG. 10, a fourth presently preferred embodiment of the novel writing platform of this invention is shown generally at 140 and includes a writing table 142, a riser 144, and a retainer strip 146. A hinge 143 hingedly joins writing table 142 to riser 144 while a hinge 145 hingedly joins riser 144 to retainer strip 146. A plurality of elongated apertures 148 are formed in retainer strip 146 adjacent hinge 145 with the longitudinal axis of each of elongated apertures 148 being parallel to the axis of hinge 145. The function of elongated apertures 148** will be discussed in detail hereinafter.

Figure 11:
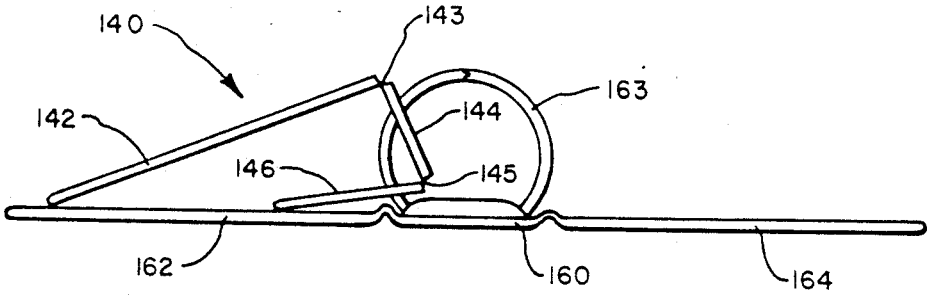
FIG. 11 is an end view of the writing platform of FIG. 10 shown in one elevated position and in the environment of a looseleaf notebook.
Figure 12:
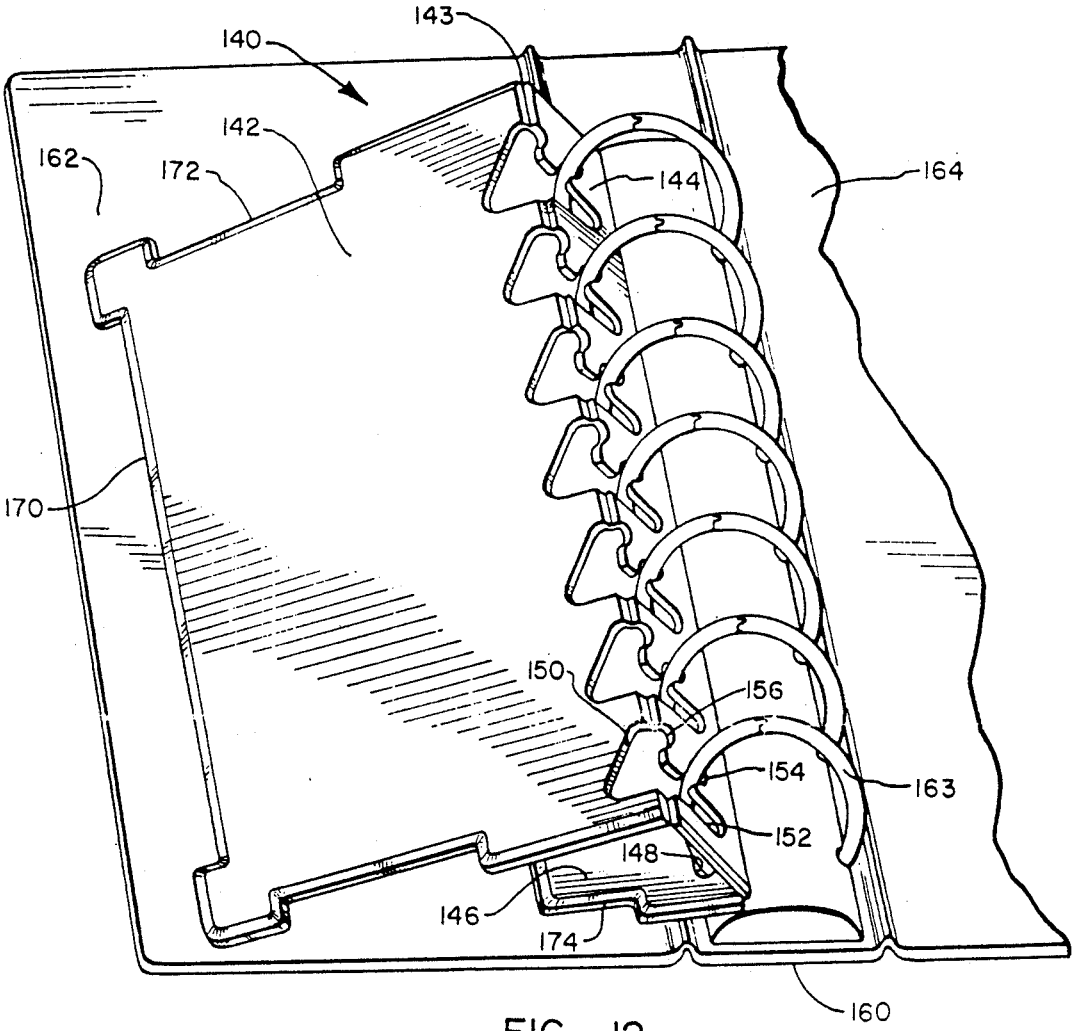
FIG. 12 is a plan view of the writing platform of FIG. 11.

A plurality of slotted brackets 150 are formed in riser 144 and a portion of the adjoining edge of writing table 142. Slotted brackets 150 are designed as engagement means for releasably engaging riser 144 to rings 163 (FIGS. 11 and 12) thereby supporting riser 144 in a generally vertical orientation so as to, correspondingly, support the adjacent edge of writing table 142 in an elevated position. Each of slotted brackets 150 has a generally F-shaped configuration with a lower slot 154 and an upper slot 156 formed generally horizontally to a vertical slot 152 to complete the F-shaped configuration. The width and length of each of elongated aperture 148, vertical slot 152, lower slot 154 and upper slot 156 are selectively predetermined so as to adapt writing platform 140 to placement into notebook 160 having various dimensions to rings 163 (FIGS. 11 and 12). It will be noted that upper slot 156 is angularly offset from the upper end of vertical slot 152 so as to allow slotted bracket 150 to be mounted to and manipulated relative to rings 163 (FIGS. 11 and 12) which may be fabricated with a range of thicknesses and diameters.

Referring now also to FIGS. 11 and 12, writing platform 140 is shown in the environment of looseleaf notebook 160 having a front cover 162, a back cover 164, and rings 163 with writing platform 140 being demountably affixed to rings 163. Retainer strip 146 is folded at hinge 145 so as to be mounted on top of front cover 162 thereby positioning elongated apertures 148 under slotted bracket 150 to accommodate each of rings 163 passing through both elongated apertures 148 and slotted brackets 150. The relationship of rings 163 with retainer strip 146 and riser 144 is best seen in FIG. 11 while FIG. 12 best illustrates the engagement of rings 163 in slotted brackets 150. In this latter illustration, rings 163 are shown engaged in lower slots 154 thereby supporting riser 144 and, more particularly, writing table 142, at the desired elevation in looseleaf notebook 160.

Figure 10:
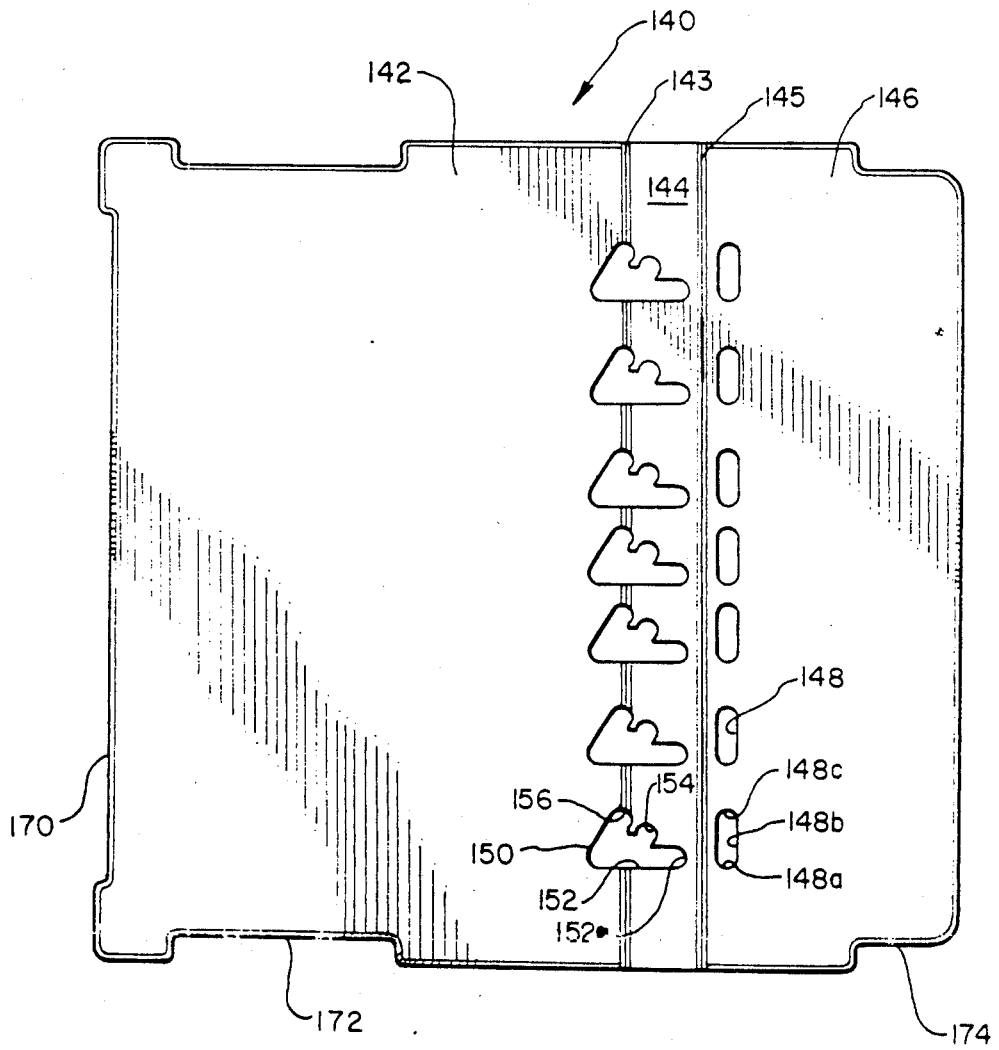
FIG. 10 is a plan view of a fourth preferred embodiment of the novel writing platform of this invention.

Elevation of writing table 142 at a desired position is accomplished by rings 163 being brought into first end **148*a* of elongated apertures 148 so that riser 144 can be raised at hinge 145 to allow vertical slots 152 to pass over rings 163 until rings 163 are brought into alignment with the predetermined slots, in this instance, lower slots 154. Writing platform 140 is then moved downwardly (toward the bottom of the drawing) to bring lower slots 154 across rings 163 and to the middle of elongated apertures 148 as represented by middle position 148*b* (FIG. 10). Thereafter, riser 144 is moved slightly to the left to bring rings 163 into engagement with lower slots 154. In this configuration, slotted brackets 150 are used to engage riser 144 to rings 163 to thereby adjustably secure the relative position of these two elements. Release of riser 144 from rings 163 is accomplished by lifting riser 144 to the right slightly to release rings 163 from lower slots 154 so that writing platform 140 can then be pushed upwardly (toward the top of the drawing, FIG. 12) thereby again bringing rings 163 into vertical slots 152. In this position, riser 144 can again be lowered against retainer strip 146 to place writing table in a coplanar position to riser 144**.

Upper slots 156 also provides the same detent features for rings 163 as lower slots 154. It will be noted that upper slot 156 extends an incrementally greater distance from vertical slot 152 than lower slot 154. This feature provides for increased strength to upper slot 156 by extending it beyond lower slot 154 so that it is supported by the solid material of riser 144 between the end of upper slot 156 and hinge 145. When rings 163 are engaged in upper slots 156, rings 163 are received in second end **148*c* of elongated aperture 148 which is why the length of elongated aperture 148 corresponds to the horizontal length of upper slot 156**.

Advantageously, the user (not shown) of writing platform 140 is able to quickly and easily elevate writing table 142 by simply raising riser 144 by folding at hinge 145 to bring vertical slots 152 across rings 163 and then sliding writing platform 140 downwardly until rings 163 are engaged in either of lower slots 154 or upper slots 156. Further, writing platform 140 is readily movable to either side of looseleaf notebook 160. This is done by removing it from rings 163, reversing it end-for-end and again engaging it on rings 163 to provide for a selectively elevated writing table 142 on the right side of looseleaf notebook 160 above back cover 164.

Advantageously, writing platform 140 is readily adaptable to being placed at any desired location among the pages (not shown, but see also pages 46 and 48 of FIG. 1) of looseleaf notebook 160. In this manner, writing platform 140 is readily usable for providing an elevated writing surface with writing table 142 at any one of a plurality of positions on either side of looseleaf notebook 160.

Cutouts 170 and 172 are formed in the edges of writing table 142 so as to allow the user (not shown) to lift the overlying pages (pages 46 and 48, FIG. 1) of looseleaf notebook 160 without disturbing writing table 142. Correspondingly, cutouts 174 are formed in retainer strip 146 to allow the user (not shown) to lift riser 144 and writing table 140 by providing access thereto without disturbing retainer strip 146.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A writing platform for a notebook comprising:

a writing table mountable in said notebook; and elevation means for elevating at least a portion of said writing table while in said notebook to provide said writing platform, said elevation means comprising a riser and a retainer strip hingedly joined together along a common edge, said riser being hingedly joined along an opposite edge to said writing table, said retainer strip including elongated apertures for removably mounting said retainer strip to rings of a looseleaf notebook, said riser including a plurality of slotted brackets, each of said slotted brackets being configured to individually engage said rings and each of said slotted brackets having a longitudinal slot extending transverse to said riser to allow said riser to be raised vertically relative to said rings, said longitudinal slot including at least one transverse slot into which said ring can be releasably engaged to hold the relative position between said riser and said ring thereby elevating said writing table.

2. A method for providing a writing platform in a notebook having a ring binder comprising:

preparing a basal element by forming a plurality of spaced, ring-receiving holes for rings of said ring binder;

mounting said basal element in said notebook by engaging said rings in said holes;

forming a writing table as a planar surface superimposed over said basal element;

selecting a riser for said writing table comprising a strip of rigid material hingedly joined along a edge to said writing table, the width of said strip determining the maximum distance said writing table can be elevated above said basal element;

engaging said riser to said notebook adjacent said rings; and elevating said writing platform in said notebook by raising said riser with said riser supporting said edge of said writing table above said basal element.

3. The method defined in claim 2 wherein said preparing step, said forming step and said selecting step all comprise fabricating said basal element, said writing table, and said riser from a unitary planar element with a first hinge between said basal element and said riser and a second hinge between said riser and said writing table, said second hinge folding said writing table into superposition over said basal element.

4. The method defined in claim 2 wherein said elevating step comprises providing detent means for releasably supporting said riser.

5. The method defined in claim 4 wherein said providing step comprises forming said detents in said riser for releasably engaging said riser to said rings.

6. A writing platform for a notebook comprising:

a writing table mountable in said notebook, said writing table comprising a planar element having a first side and a second side, said first side having a plurality of detents adjacent a first edge and a plurality of spaced holes spaced from and parallel to said first edge, said spaced holes comprising retainer means for releasably mounting said planar element to rings in a looseleaf notebook, the portion of said planar element between said detents and said spaced holes comprising a basal element, a riser adjacent said spaced holes, said riser being formed from said planar element between a first hinge and a second hinge, said first hinge being adjacent and parallel to said spaced holes and operable to allow said riser to be raised from the plane of said planar element at said first hinge, said second hinge being parallel to said first hinge and pivoting the remainder of said planar element to a position superimposed over said basal element, said remainder of said planar element comprising a writing surface with said second side exposed above said basal element, a portion of said riser and said writing surface comprising slots spaced from and coordinated with said spaced holes, each of said slots having a longitudinal axis perpendicular to the line of said spaced holes;

elevation means for elevating at least a portion of said writing table while in said notebook to provide said writing platform, said elevation means comprising said riser elevating said second hinge above said basal element when a second edge of said writing surface is engaged in said detent means.

7. The writing platform defined in claim 6 wherein said elevation means comprises adjustment means for adjustably positioning said writing surface by selectively spacing said detents so as to provide a plurality of positions to which said writing surface may be selectively raised.

8. The writing platform defined in claim 6 wherein said writing table comprises stiffener means on the underside of said writing surface.

9. The writing platform defined in claim 8 wherein said stiffener means comprises a raised lettering.

10. A writing platform for a notebook comprising:

a basal element mountable in said notebook, said basal element comprising mounting means for releasably mounting said basal element to a looseleaf notebook, said mounting means comprising a plurality of spaced holes adjacent said first hinge, said spaced holes being adapted to being engaged on rings of a ring binder of said looseleaf notebook;

a writing table superimposed over said basal element;

elevation means for said writing table comprising a riser formed as a stiffened strip hingedly joined between said writing table and said basal element, said riser and said writing table including a plurality of elongated slots spaced from and coordinated with said spaced holes, said slots passing over said rings in said spaced holes so as to allow said riser to be hingedly moved at said first hinge from a first position in juxtaposition on said basal element to a position angularly offset from said basal element and supporting said writing surface above said basal element; and detent means for releasably supporting said riser in a generally vertical orientation relative to said writing table.

11. The writing platform defined in claim 10 wherein said basal element, said riser, and said writing table are formed from a planar element having a first side and a second side with said riser being formed in said planar element as a strip hingedly joined on a first edge at a first hinge to said basal element and on a second edge at a second hinge to said writing table, said writing table being folded at said second hinge so as to be superimposed over said basal element with said second side of said writing table forming a writing surface.

12. The writing platform defined in claim 10 wherein said detent means comprises detents for releasable engaging an edge of said writing table opposite said riser.

13. The writing platform defined in claim 10 wherein said detent means comprises detents in said riser for releasably engaging said riser on said rings.

14. The writing platform defined in claim 10 wherein said writing table comprises stiffener means beneath said writing surface.

15. The writing platform defined in claim 10 wherein said stiffener means comprises a logo formed as a raised surface.

* * * * *